United States Patent [19]

Johnson, II

[11] Patent Number: 4,892,319

[45] Date of Patent: Jan. 9, 1990

[54] WORD GAME

[76] Inventor: Theodore D. Johnson, II, 3900 Pebble Creek Rd., Midlothian, Va. 23112

[21] Appl. No.: 221,555

[22] Filed: Jul. 20, 1988

[51] Int. Cl.[4] ..... A63F 3/00; A63F 9/04

[52] U.S. Cl. ..... 273/272; 273/146

[58] Field of Search ..... 273/272, 146, 240, 299

[56] References Cited

U.S. PATENT DOCUMENTS

| | | | |
|---|---|---|---|
| 1,586,429 | 5/1926 | Kiesling | 273/146 |
| 1,674,533 | 6/1928 | Templeton . | |
| 2,684,853 | 7/1954 | Withers | 273/272 |
| 3,195,896 | 7/1965 | Kropinski | 273/146 |
| 4,014,548 | 3/1977 | Trilling | 273/272 |
| 4,306,724 | 12/1981 | Brzezinski et al. | 273/243 |
| 4,341,487 | 7/1982 | Freyman | 273/272 |
| 4,448,423 | 5/1984 | Augusta | 273/272 |
| 4,637,609 | 1/1987 | Vanderhoof | 273/272 |
| 4,735,419 | 4/1988 | Koca | 273/146 |

*Primary Examiner*—Edward M. Coven
*Assistant Examiner*—Benjamin Layno
*Attorney, Agent, or Firm*—Staas & Halsey

[57] ABSTRACT

An apparatus for a word game is disclosed. A game board surface is divided into a number of squares into which playing pieces containing the letters of the alphabet are placed to complete a word. The various words are contained in groups which, when of a certain size, are considered to be an ISLAND which creates the right to start a new word independent from all the other which is an ATOLL. Except for ATOLLS and the beginning of the game, any new letters added must form a word with those letters already on the playing field. New words which link one ISLAND to another ISLAND or ATOLL are ISTHMUSES and capture the ISLAND or ATOLL to which they are linked as part of the territory for the player creating such an ISTHMUS. Two iscosahedron dice having their faces numbered from 1 to 20 are used to randomly select numbers from 2 to 40. These numbers are related to the letters of the alphabet by a decoder with the frequency of number approximating the frequency of the use of the letters in making words. The seldom used letters of the alphabet are increased through the use of a number of bonus letters and the value of the individual letters vary based on a scoring code. The individual ownership of ATOLLS, ISTHMUSES and ISLANDS is shown by a color-coded transparent flag placed on top of one of the previously played letters.

8 Claims, 9 Drawing Sheets

FIG. 2
| | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| 2 | 3 | 4 | 5 | 6 | 7 | 8 | 9 | 0 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 |
| X | J | K | * | A | B | W | O | P | M | E | E | C | S | N | L | T | * | H | I | R | * | T | D | A | N | S | O | E | U | F | G | R | Y | * | V | * | Qu | Z |
FIG. 3
| | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| A | B | C | D | E | F | G | H | I | J | K | L | M | N | O | P | Qu | R | S | T | U | V | W | X | Y | Z | | | | | | | | | | | | | | | | |
| 2 | 8 | 5 | 4 | 1 | 6 | 6 | 3 | 2 | 10 | 9 | 3 | 5 | 2 | 2 | 6 | 10 | 3 | 2 | 1 | 5 | 9 | 7 | 10 | 8 | 10 | | | | | | | | | | | | | | | | |
FIG. 5
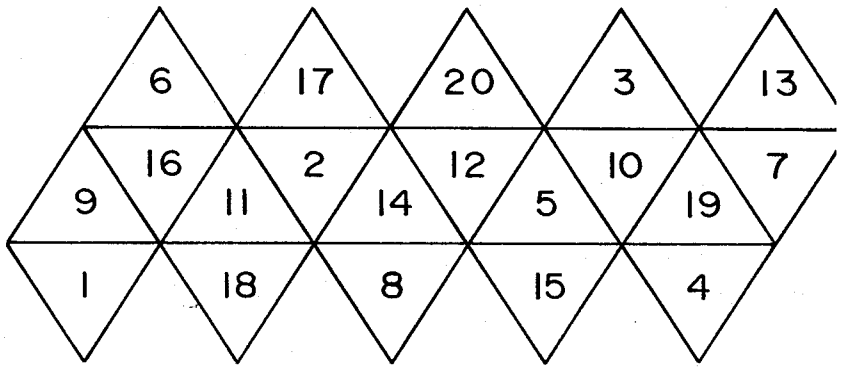
FIG. 4
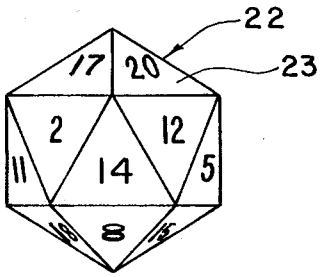

WORD GAME

The present invention relates to a word game apparatus and method where tiles carrying letters are used to form crosswords.

There have been numerous word games in the past using a multiplicity of players who play letters, that are randomly selected, onto a board to compose words. One of the most popular of these word games is the game sold under the trademark SCRABBLE. In SCRABBLE TM, words are formed using single letter tiles selectively placed in square spaces marked off on a flat game board. The tiles are placed in a crossword pattern and scoring is determined by point values assigned to the tiles as well as bonuses assigned to some of the letter spaces on the board.

In accordance with the present invention, the word game utilizes a pair of die referred to as "dice" each of which have 20 equal triangular sides. The die is in the shape of an icosahedron which is one of the five platonic solids.

The 20 faces of the die are numbered from 1 to 20. The sum of the two top faces of a pair of thrown dice will equal any of the numbers from 2 to 40 which are converted by a CODE to a letter of the alphabet and bonus letters. Bonus letters can be any letter of choice by the player.

The players start off by obtaining a number of tiles having the letters thereon and form an initial word which is placed in a corner of the playing board. A transparent tile having a color identifying the player is placed on the first letter and this identifies the group of letters as belonging to that player. As the game proceeds, the initial word is built up in cross word fashion until it reaches a certain size which then becomes an ISLAND. At this point, the player has the right to form a new three letter word anywhere on the playing field which is referred to as an ATOLL. Also, the player places a transparent colored tile on the first letter of the ATOLL to indicate his ownership.

These transparent color tiles are referred to as FLAGS.

The player is able to place letters building a word that bridges one of his islands with another island or ATOLL. This forms an ISTHMUS. If the ISTHMUS bridges to a territory of another player, it captures that territory. When one player has captured the entire board, that player is the winner.

Thus, a game is provided that has all of the letters of the alphabet available for selection at all times based on a throw of the dice and a game which is both highly competitive and educational with strategy playing an important part in determining who wins the entire board. For a fuller understanding of the nature and advantages of the invention, reference should be made to the accompanying drawings and the detailed description including the instructions for playing the game and the sample game.

BRIEF DESCRIPTION OF THE DRAWINGS

FIG. 2 shows the code of the present invention;

FIG. 3 shows the scoring card of the present invention;

FIG. 4 is a view of one of the two icosahedron die of the present invention;

FIG. 5 shows the 20 sides of FIG. 4 unfolded to show the arrangement for the numbers on the various faces.

Referring now to FIG. 1, there is shown a flat game board or playing field 20 which is marked off in a matrix of 19 squares by 19 squares. The individual squares may be optionally designated by a number and letter cross-referenced such as shown in FIG. 20.

Figure 1:
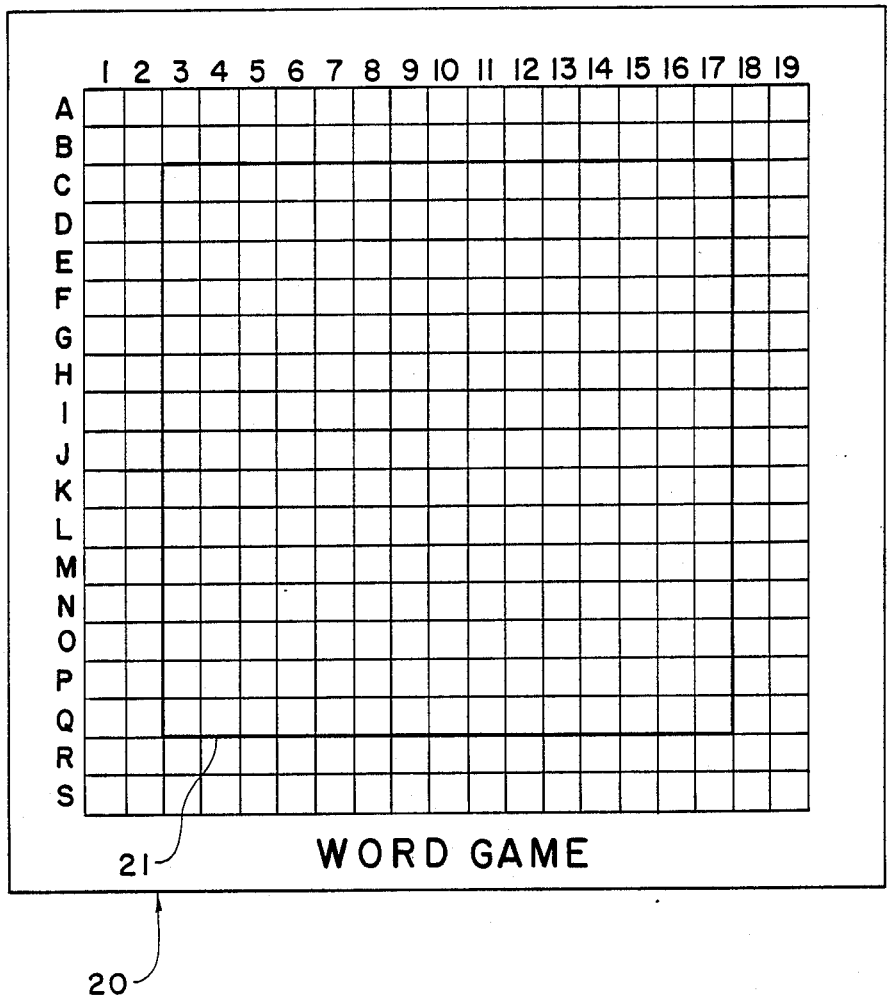
FIG. 1 shows the game board of the present invention.

There are 1 to 19 numbers on the horizontal and 19 letters, A through S, on the vertical making the first square on the upper left corner A1 or 1A. If it is a vertical word, the coordinate begins with a number and if it is a horizontal word, the coordinate begins with a letter. These letters and numbers can be used if the players wish to use them to record a game.

The individual squares are approximately the same size as tiles which are placed thereon carrying either the letters of the alphabet or a star or other designation indicating the tile is a bonus which can be any letter selected by the player.

Within the borders of 19×19 matrix, there is provided a darkened second border 21 to designate a smaller surface upon which to played. This second border marks a field 17×17 for those desiring to play a less advanced game. Of course, other sizes could be selected but for the present invention this indicated size has been found to be the preferred embodiment.

With reference to FIG. 4, there is shown a die in the shape of an icosahedron 22 which has 20 equal triangular faces 23 with each face having a different number from 1 to 20. Two of the die form a pair of icosahedral dice are used in the game. When playing the game, the sum of the two uppermost faces are used to determine a number from 2 to 40.

With reference to FIG. 5, there is shown the unfolded icosahedron die 22 and the numbering arrangement being utilized. The opposite faces on the die equal the sum 21.

With reference to FIG. 2, there is shown the CODE by which the number of 2 to 40 obtained by a throw of the dice is decoded to an individual letter of the alphabet or a star. By referring to the figure, it is seen that "2" decodes to "x" and "40" to "z" whereas "5" decodes to a "star". The "star" indicates a bonus which can be interpreted by the player to be any of the letters of the alphabet. It is also to be noted that 39 decodes to "Qu" rather than mere "Q", since the two letters are always used together in forming words.

It is to be noted that there is only a single combination of the dice, "1" and "1", that can create a sum of "2". There are two possibilities, "1" and "2" and "2" and "1", for a sum of "3". There are three possibilities for a sum of "4", and the number of possible combinations keep increasing to a maximum of twenty possible combinations for a sum of "21". The possible combinations then decrease to again a single combination for the sum of "40".

This variation in the number of possible combinations for each number between "2" to "40" is important in allocating the numbers to the letters. As can be seen by the CODE in FIG. 2, all of the letters of the alphabet have a single thrown number allocated except, "A", "N", "O", "R", "S" and "T" which have two thrown numbers, allocated and "E" which has three thrown numbers allocated. Also, five thrown numbers are allocated to bonus letters which can be considered as any letter assigned by the player.

The frequency that a thrown number can occur plus all the thrown numbers assigned to a letter determines the likelihood that a specific letter will result from a throw of the dice. The allocation of the numbers and quantity of numbers assigned to each letter is made on the basis of occurrence of that letter in the words that would normally be played in word games. It is to be noted that the ratio of consonants to vowels in text is different than the ratio in single words as used in word games which have a fewer vowels. Also, some letters such as K, J, Z, X seldom occur in the words of word games, these letters can be assigned to the bonus letters.

With reference to FIG. 3, there is shown a value of the individual letters which may be assigned during scoring. The use of varying values based on the frequency of letters is optional.

The use of the game board of FIG. 1, CODE of FIG. 2 and the scoring of FIG. 3 will become clear after reading the following instructions, followed by the sample game.

It should be noted that some of the equipment called for the instructions is not shown in the drawings. The MAGAZINE for holding the supply of letters can be any suitable container for this purpose. The DECK which is not shown in the drawings can be any box in which the dice are thrown or optionally no box need be used at all. Likewise, the PROA or rack for holding the letters can be any suitable rack including the type normally used in SCRABBLE TM. The throwing cup used can be a standard throwing cup for dice or optionally not used. The FLAGs are merely transparent tiles with an approximate shape of the squares on the board to overlay a letter which is visible through the transparent colored material. It would normally be made of plastic. The individual letters are on tiles also approximately the size of the squares of the board and can be made from any suitable material. The letters would normally appear in capitals. For purposes of designating tiles that have been previously played, the figures illustrating the sample game shows some of them in lower case letters for purposes of illustration.

Instructions

The invented words below are used in these instructions in order to avoid the redundancy that results when a statement is intended to address both sexes.

Ho, pronounced hoh, means he or she.
Hom, pronounced home, means him or her.
Hos, pronounced hose, means his or hers.

Seating

Because of the need to study the board while others are playing, in order to make astute moves and speed up the game, all the players should be seated in such a way as to be able to see the board right side up at all times.

Overview of Word Game

The word game is a crossword type where two, three or four players or teams place a six letter word so that the first or last letter is in one of the four corners of the board. When a player has expanded these original words so that it has fifteen or more letters in the group, it has reached the status of ISLAND. Once this has been accomplished, the player has the option to place three letter words, called ATOLLS, any place on the board. The atoll may then be built to the status of island also. By the development of these territories, as well as by their strategic placement, one reaches a point when one can build an ISTHMUS to an opponents island or atoll, thus capturing it. When one player has captured the entire board ho is the winner.

Equipment

The BOARD 20 is marked with two different sized boards. The entire board 20 is 19 by 19 squares and requires a starting word of six letters. The next outlined board 21 is 17 by 17 squares and starts with a five letter word. This choice of board sizes allows for shorter game times and increase or decrease in size of the board depending on the number of players. The smaller board also allows for the spelling abilities of young children.

The CODE as shown in FIG. 2 is the set of numbers from 2 to 40 with the letters of the alphabet they represent directly under them. The numbers are all the numbers that can be thrown when the up faces of the dice are summed. There are also numbers marked with a star. When these numbers are thrown one may get a letter of one's choice over and above the usual number of letters. This use of the dice eliminates the drawback of other word games that are restricted to a preset number of letters. The letters like Z, X, K, which have low probabilities can nevertheless be acquired throughout the game. Code bonus "stars" also help in getting low percentage letters.

The MAGAZINE holds the supply of letters, some blank letter tiles (in the event the magazine runs out of a letter), and the transparent color FLAGS. Usually one player dispenses the letters to all the players as the dice are thrown.

The FLAGS are four different colored transparent tiles, which are placed on the first letter of the first word of all territories to identify ownership. They may be used at will to help identification as the number of letters on the board increases enough to make territory identification difficult. (In the sample game shown in the drawings, the words are cross-hatched instead of flagged.)

The DECK is the box into which the dice must be thrown from the THROWING CUP. A player indicates the end of ho's turn when ho returns the dice to the cup. If a die is tilted or thrown out of the deck, both dice are rethrown. The deck also can serve as the lid for the magazine.

The PROA is the rack for holding the letters obtained by each player. The proa should be visible to all the players.

The SCORE SHEET (optional) keeps a running score for each player. The scores obtained by adding the values of all the letters that made new words on each turn. Also, one point is given for each letter in a captured players territory when a capture is made. There is a hundred point bonus given to the winner of a game. A score keeper should be chosen. See score of the sample game in the Appendix.

The DICE are icosahedrons (20 sided) which have 400 ways in which all possible pairs of numbers may be thrown. This large number makes it possible to choose according to the odds by which they can be thrown. These odds are made to coincide with the percentage distribution of the letters of the alphabet as they are found in word construction for word games in the English language.

HOW TO PLAY

The highest throw of the dice goes first. To begin, each player, in turn, places a six letter word of hos own choosing so that its first or last letter is in one of the four corners of the board. Words may be placed vertically or horizontally. After placing the original word, each player then throws the dice eight times to obtain the first letters of the proa (hand). This constitutes the first turn.

The second turn, and probably several turns thereafter, require building the original word, crossword style, to fifteen total letters so that it can reach the status of an ISLAND.

Once the island is established, it is then possible to place ATOLLS anywhere on the board. Atolls are three letter words that can also be built into islands, which only require ten total letters. The need for islands stems from the fact that only islands can capture other islands and capturing islands is the only way a game can be won.

One can capture an opponents territory or annex one's own territory by building an ISTHMUS. An ISTHMUS is any word that also makes words at each of its ends in the territories it connects.

At the end of each turn the player throws the dice twice to partially replenish hos proa. Sooner or later, however, a player will run short of letters in hos proa. When this happens, the player has no option but to PASS, which means that no plays can be made to the board on that turn. The player, however, can throw the dice four times instead of two to increase the number of letters in hos proa. The option to pass may be used on any turn regardless of how many letters are in the player's proa.

The play continues, expanding islands and atolls, placing atolls in strategic offensive and defensive locations, and, of course, using isthmuses to annex one's own and capture opponent's territory. Atolls may capture or annex atolls but not islands. Islands can capture or annex any territory.

Toward the end of the game, when the last two players come to the place where one has captured all the other's islands, the losing player may still attempt to build a remaining atoll into an island in the unlikely hope of making a comeback.

SCORING (optional)—On the bottom of the letters of the code are their values for scoring purposes. A running score is kept for each player by adding the score of each letter played. It is remotely possible that the loser could have a higher score than the winner, but the winner gets a hundred points for winning. When a capture is made, any time during the game, the capturer gets the letter score for the isthmus and of the word game made at the end of the isthmus in both territories. Ho also gets one point for each letter in the captured territory. See the illustration of the scoring of the sample game in the Appendix.

TEAMS—When playing as teams, the team plays as a single unit and the whole team has one proa.

Because the board is made large with large letters, it may be played as a party game where the group is divided into two, three, or four teams of any size. The groups discuss what is to be played and where to play it. This usually makes for better games because more minds tend to discover what individuals may not. A two minute time limit is suggested.

RULES

WORD PLACING—All words placed on the board crossword style or as isthmuses must make words wherever they make contact with other words. Newly created atolls are expansions of one's territory must be separated from any other territory by at least one empty square. This means that they may be corner but not side to side.

THROWING THE DICE—The dice are always thrown at the end of a players turn. They are thrown twice if the player has played to the board on that turn, or four times if the player has passed. The letter indicated by the code should be obtained from the magazine at the end of each throw. The dice must be thrown from the cup into the deck and flat on their surfaces; if not, they must be rethrown. Bonus letters of the players choice are received from the magazine when the code indicates an "*" instead of a letter. Bonus letters are above the normal count of two or four throws of the dice.

ERRORS—If an error is not discovered before a turn ends, it must stand throughout the game. When scoring (optional), a player who does not score all the letter score for words made during that turn cannot score them at a later time.

DICTIONARY—A dictionary should be made available to the players in order to determine the validity of words in the case of a disagreement. Plurals, prefixes and affixes normally given to words are, of course, allowed even if not specifically given in the dictionary. Foreign words and proper nouns may not be used. Other rules may be made by consent of all the players.

STRATEGIES

The word game lends itself to many possible strategies that can offset the luck of the letters the dice offer.

The choice of the original word.

Because of the requirement of placing the first or last letter in the corners of the board, consideration must be given to a word that gives maximum opportunity to use the letters in that word as beginning or ending letters for the second word, depending on where the original word is placed.

When building islands consideration must be given to exposure on too many fronts. Making islands larger than they need to be lessens the opportunity to build atolls.

Atolls may be placed either defensively (around and near the islands) or offensively by occupying space elsewhere on the board, so as to give minimum opportunity to the opponent and maximum opportunity to capture enemy atolls. At the same time, space should be sufficient to build the atoll into an island.

Capturing territory eliminates opponents but at the same time increases the attackable perimeter of the territory.

Any turn may be passed regardless of the ability of play letters in order to accumulate many letters in the proa. This contrasts with the fact that in the meantime the opponents are acquiring territory.

Making long words versus short words can be good or bad depending upon the situation.

Annexing an atoll with an atoll gives the opportunity to build them both to an island in one turn. Annexing an atoll by one of the islands has dubious merits, except as a defensive ploy to prevent an opponent's atoll from capturing it. (Atolls cannot capture islands.)

There are many other possible strategies in addition to those enumerated.

With reference to FIGS. 6–18, there is shown a sample game:

SAMPLE GAME

Note: In FIGS. 6–18, the drawings are specially hatched to indicate the various colors. The hatching is as follows: Red is shown in upper left of FIG. 6, Green is shown in upper right of FIG. 6, Blue is shown in lower right of FIG. 6, and Orange is shown in lower left of FIG. 6.

Figure 6:
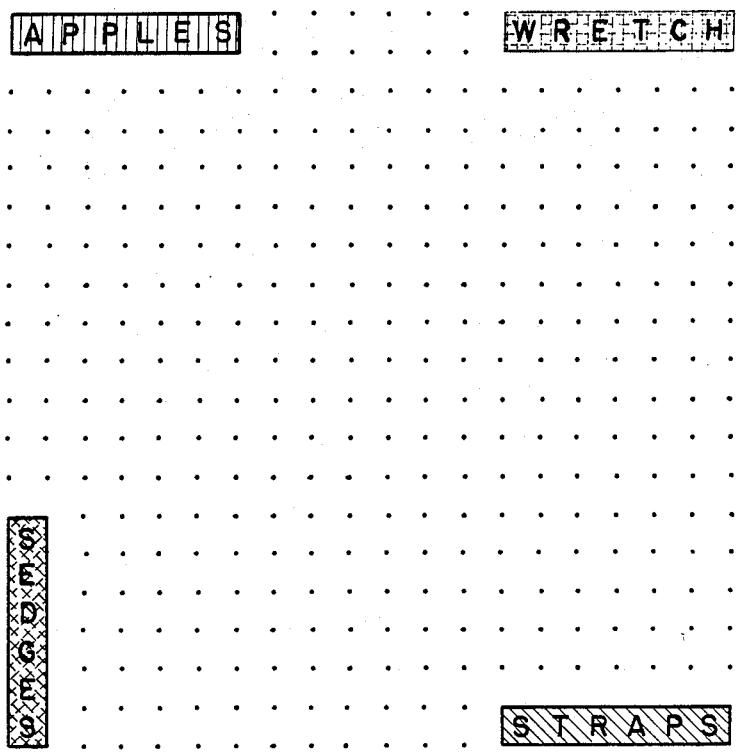
FIGS. 6 through 18 show a sequence of moves made in playing a sample game.

Turn 1. With reference to FIG. 6, all the players have placed the six letter word of their choice, after which they have thrown the dice eight times to obtain the starting letters for their proas. In this example the proa letters have been omitted for simplicity. After each turn in the subsequent FIGS. 6 to 18, each player has thrown the dice 2 or 4 times to add letters to the proa and if they are lucky they have gotten some bonus letters we well. Capitalized words are those played on that turn. Lower case letters are words played on previous turns.

Figure 7:
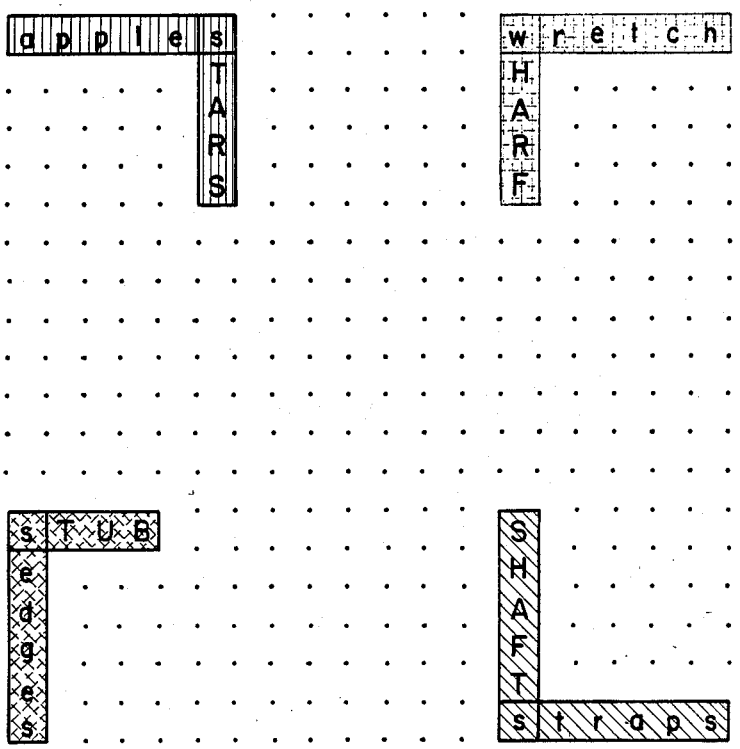

Turn 2. With reference to FIG. 7, all the players on their turn are adding letters to the original word in order to get fifteen letters so that they may make the first ISLAND. They may not start atolls until this is done. Lower case letters indicate word played on previous turns. Capitals are the words or letter played on this turn.

Figure 8:
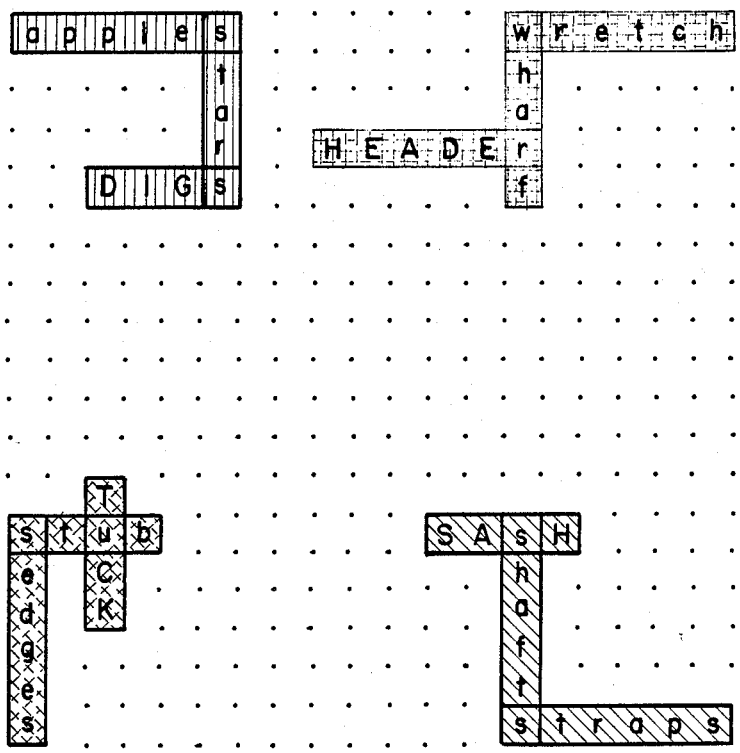

Turn 3. With reference to FIG. 8, Green has 15 letters and may place an atoll on hos next turn.

Figure 9:
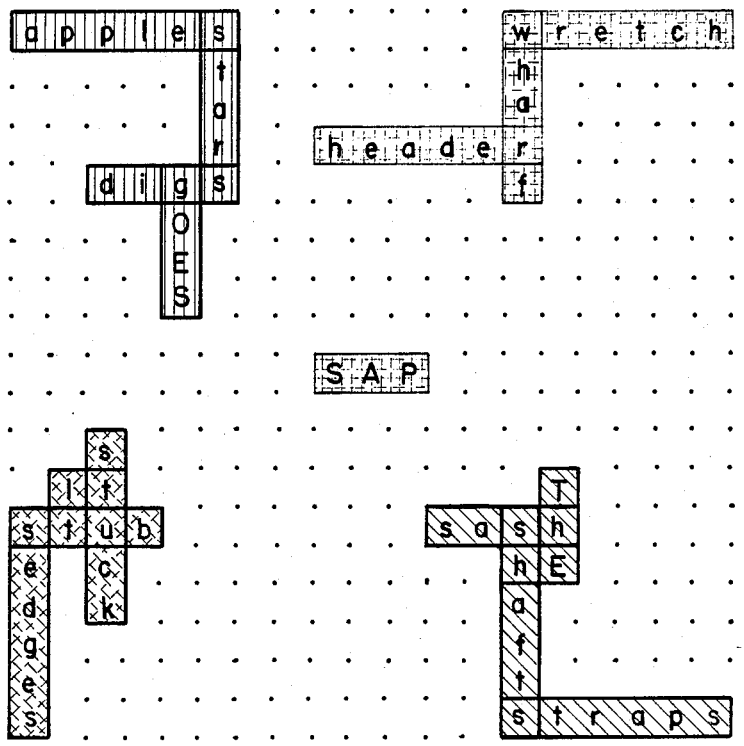

Turn 4. With reference to FIG. 9, Red and Blue have now reached 15 letters. Green places the first atoll (SAP).

Figure 10:
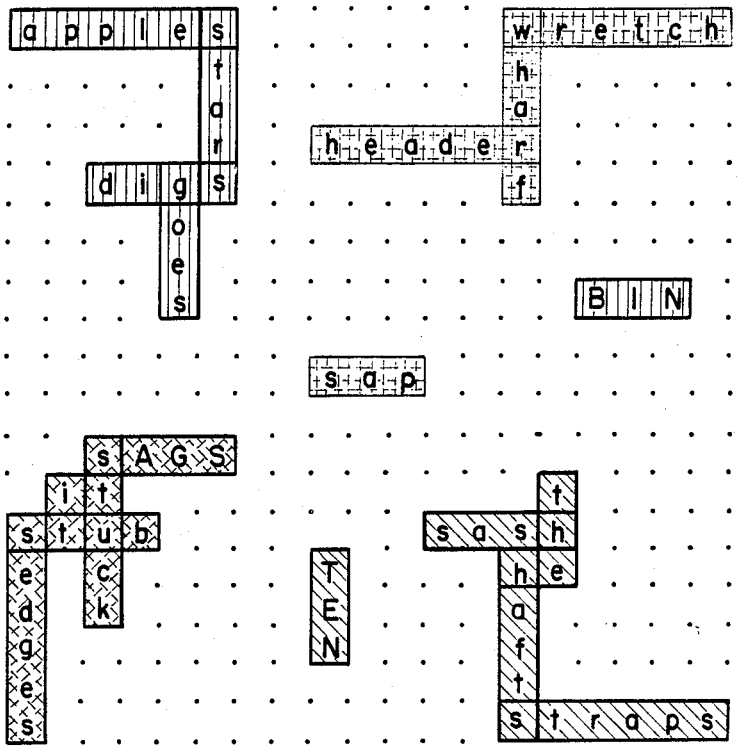

Turn 5. With reference to FIG. 10, two more atolls are placed. Green had to pass to get 4 letters for his depleted proa. With luck on dice throws one can get bonus letters of one's choice, which is the only way to beat the odds of getting seldom used letters like Z and K.

Figure 11:
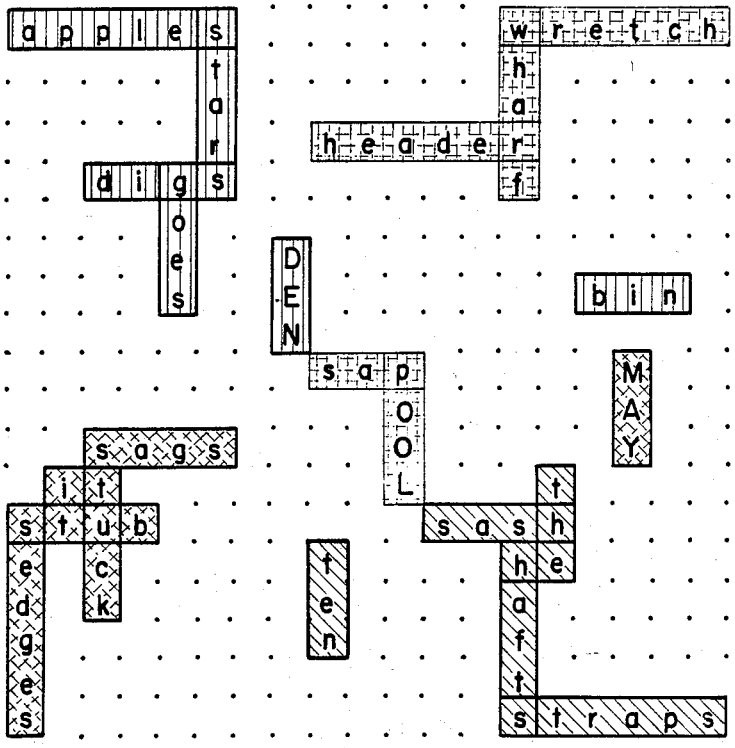

Turn 6. With reference to FIG. 11, Red places a second atoll. Green extends hos atoll in order to reach 10 letters in it, thus making a second island. Although atolls can capture atolls with ISTHMUSES, islands cannot be captured except by islands. Islands can capture atolls as well. Orange finally got hos first atoll.

Figure 12:
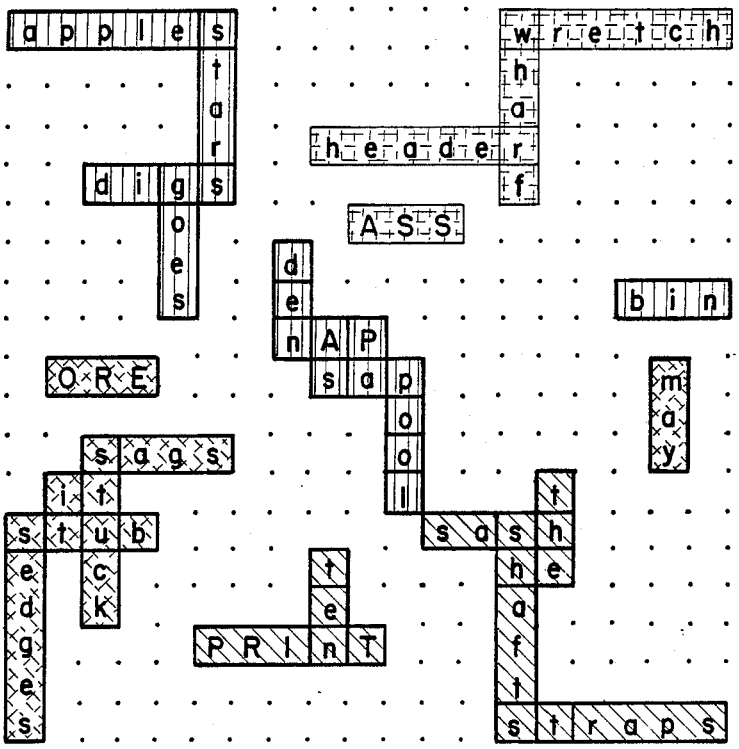

Turn 7. With reference to FIG. 12, RED captures Green's atoll with the isthmus (nAP). Note that the letters make a word, nAP, and As and Pa in the captured atoll. Green makes another atoll (ASS), Orange makes an atoll too (ORE). Blue adds to hos atoll (PRInT).

Figure 13:
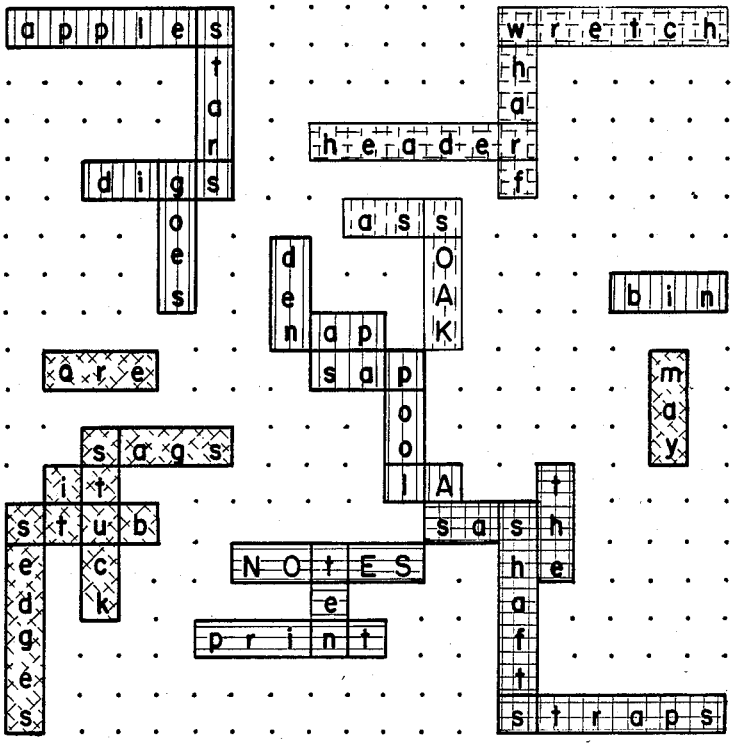

Turn 8. With reference to FIG. 13, Red's isthmus 1A captures Blue's island leaving him with only an atoll. Blue immediately promotes it to island status with NOtES. Green adds to hos atoll (sOAk). Orange has letters but cannot use them so ho passes hos turn and get 4 letters plus any bonus letters.

Figure 14:
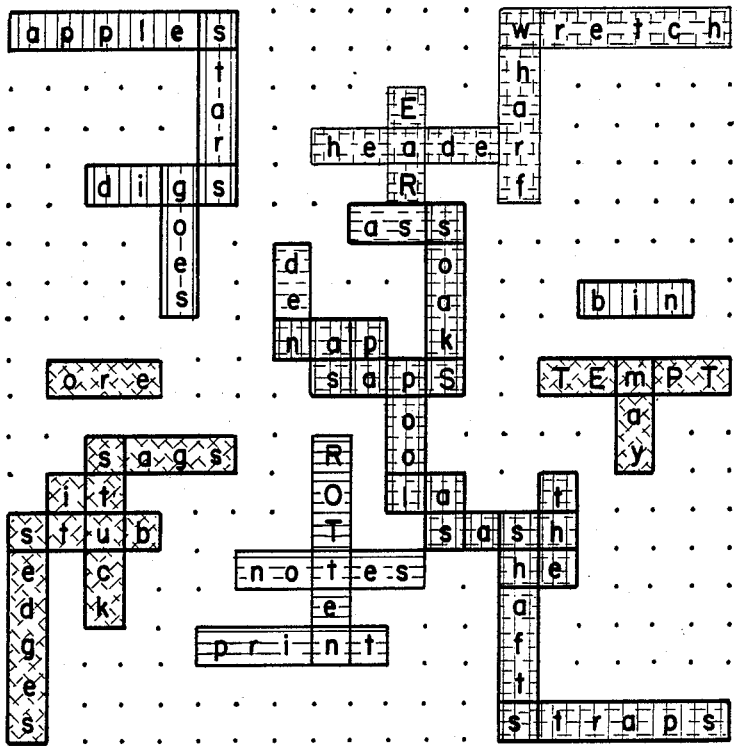

Turn 9. With reference to FIG. 14, Red captures Green's atoll by adding an S to sapS and soakS. Green immediately responds with EaR and recaptures hos atoll and Red's island. Orange adds TEmPT to hos atoll. Blue extends hos island with ROTten.

Figure 15:
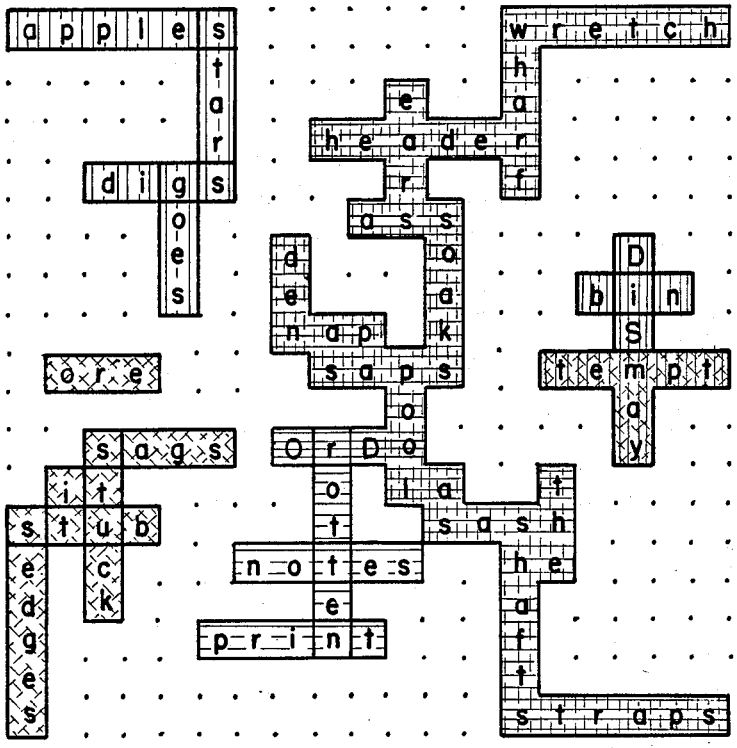

Turn 10. With reference to FIG. 15, Red captures Orange's atoll with DiSmay. Green is forced to pass as is Orange. Blue captures and eliminates Green with OrDo. (Ordo required the use of the dictionary to confirm that it was a word.)

Figure 16:
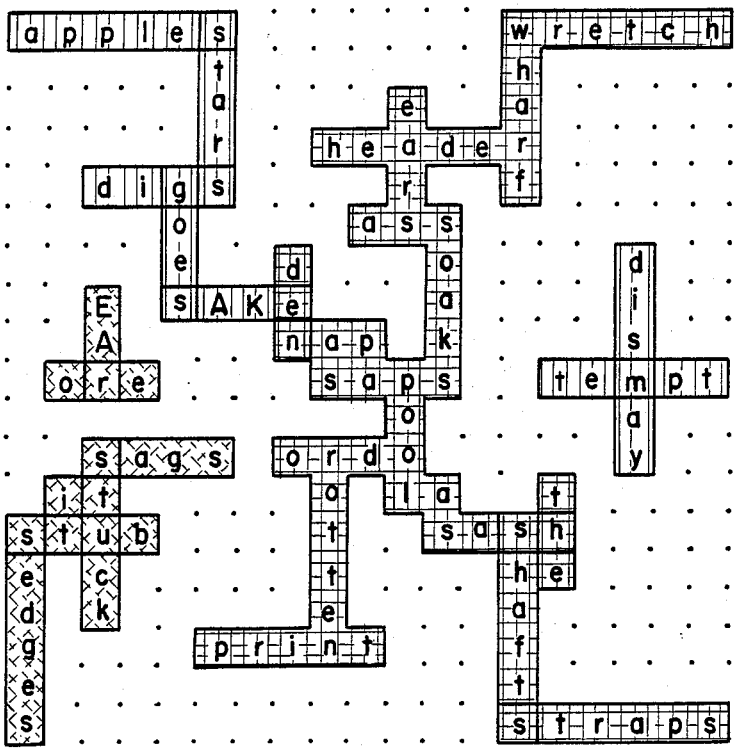

Turn 11. With reference to FIG. 16, Red captures Blue and eliminates hom with sAKE. Orange expands hos atoll with EAr.

Figure 17:
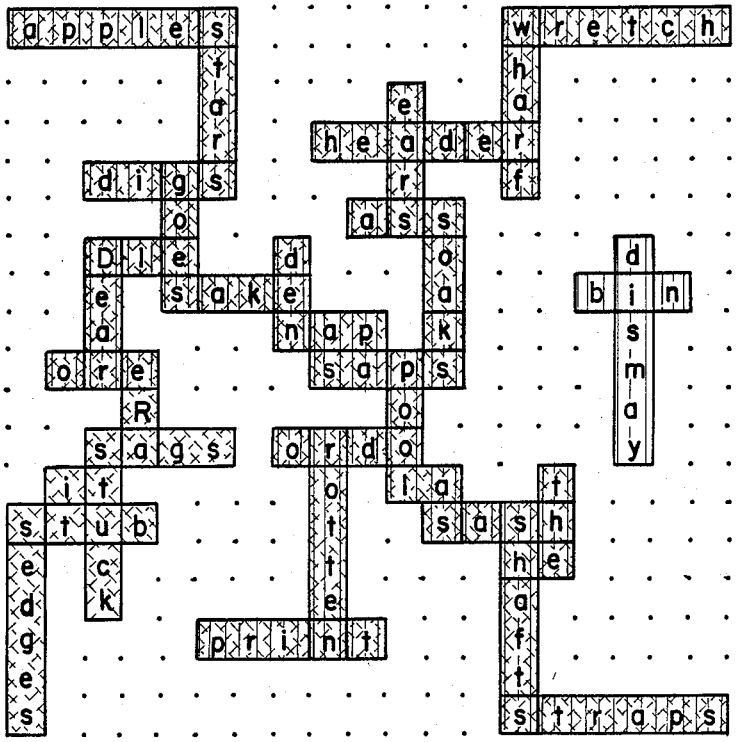

Turn 12. With reference to FIG. 17, Red captures Orange's atoll with DIe. Orange retaliates with eRa and now owns the whole board except for the Red atoll.

Figure 18:
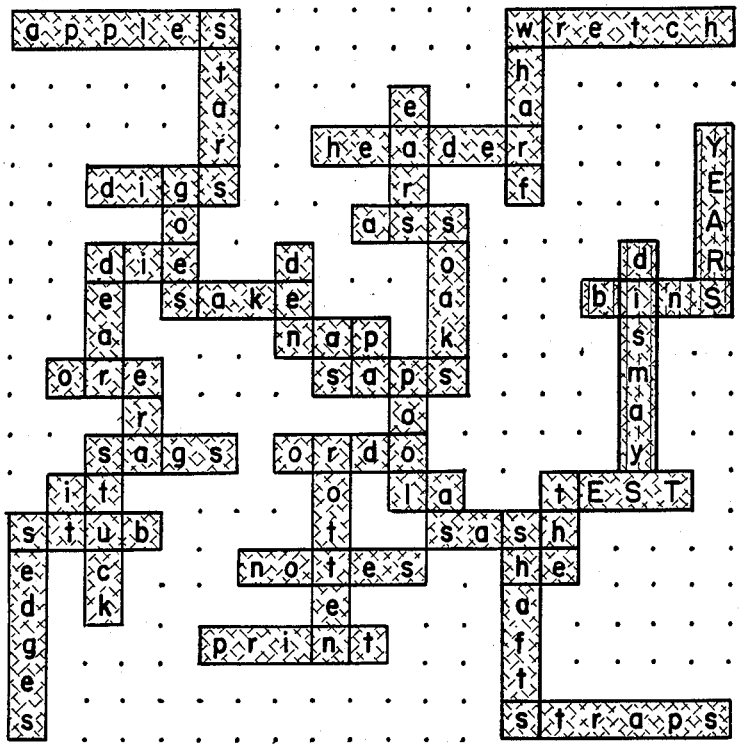

Turn 13. With reference to FIG. 18, Red is forced to add YEARS to hos atoll because ho cannot capture Red's island unless ho has at least 10 letters and ho only has eight. Orange plays tEST and wins the game.

Note that Orange was the underdog throughout the whole game but came through in the end.

It is obvious that the method for playing the game can also be utilized in a home computer or a video game as an alternative to the portable board game described above.

Although an illustrative embodiment of the present invention has been described herein with reference to the accompanying drawings, it should be understood that the invention is not limited to the precise embodiment and various changes and modifications may be effected therein by one skilled in the art without departing from the scope or spirit of this invention.

RED'S (OPTIONAL) SCORE SHEET IN SAMPLE GAME

| TURN | WORD(S) | WORD SCORE | CAPTURE POINTS | TURN TOTAL | GRAND TOTAL |
|---|---|---|---|---|---|
| 1 | APPLES | 0 | 0 | 0 | 0 |
| 2 | STARS | 10 | 0 | 10 | 10 |
| 3 | DIGS | 14 | 0 | 14 | 24 |
| 4 | GOES | 11 | 0 | 11 | 35 |
| 5 | BIN | 12 | 0 | 12 | 47 |
| 6 | DEN | 7 | 0 | 7 | 54 |
| 7 | NAP | 10 | | 10 | |
| | AS | 4 | | 4 | |
| | PA | 8 | 4 | 12 | 80 |
| 8 | LA | 5 | | 5 | |
| | AS | 4 | 15 | 19 | 104 |
| 9 | SAPS | 12 | | 12 | |
| | SOAKS | 17 | 2 | 19 | 135 |
| 10 | DISMAY | 23 | 0 | 23 | 158 |
| 11 | SAKE | 14 | 51 | 65 | 223 |
| 12 | DIE | 7 | | 7 | |
| | DEAR | 10 | 2 | 12 | 232 |
| 13 | YEARS | 16 | 0 | 16 | 248 |

Red was eliminated on this last turn.

Note: Words made in capture territory count as words but are not recounted as capture points. The rest of the letters in the captured territory count one point each.

What is claimed is:

1. 1 A word game comprising:

a playing area;

a matrix of letter spaces in said playing area;

a plurality of playing tiles for playing in said letter spaces, said tiles have thereon varying letters of the alphabet and bonus letters indicia;

a random number selector for the chance selection of a single number from up to at least 30 or more;

a code for converting said randomly selected numbers to a single constant letter of the alphabet or bonus letter with said chance selection of numbers approximating the frequency of letter usage in word games;

said playing tiles selected by said chance selection of numbers and said code conversion of the numbers being initially arranged and played by a player of the game to form a word as that player's territory in said playing spaces at a corner of said matrix of said playing area with subsequent playing tiles added at the player's turn to the player's territory in cross-word fashion when additional words can be created.

2. The word game of claim 1, which includes an ownership indicia to indicate the ownership of said territory by a given player.

3. The word game of claim 2, wherein said indicia of ownership is a transparent tile color-coded to individual players which is added on top of a playing tile in a given player's territory.

4. The word game of claim 1, wherein said random number selector is a pair of icosahedron shaped dice with each of the twenty triangular faces having a different number from 1 to 20 whereby the sum of the upper faces of the die pair will produce random numbers from 2 to 40.

5. The word game of claim 4, wherein said matrix of letter spaces is a square containing a multiplicity of square letter spaces horizontally and a multiplicity of square spaces vertically.

6. The word game of claim 5, wherein said matrix of letter spaces encompasses a delineated smaller matrix of letter spaces.

7. The word game of claim 6, wherein said matrix is nineteen by nineteen letter spaces and said smaller matrix is seventeen by seventeen letter spaces.

8. The word game of claim 7 which includes a score for assigning different values to different letters of said playing tiles.

* * * * *